US009835336B2

(12) United States Patent
Gross

(10) Patent No.: US 9,835,336 B2
(45) Date of Patent: Dec. 5, 2017

(54) HEATING SYSTEM INCLUDING A SAFETY SCREEN

(71) Applicant: ORTAL—HEATING & AIR CONDITIONING SYSTEMS LTD., Hod Hasharon (IL)

(72) Inventor: Benjamin-Tal Gross, Hod Hasharon (IL)

(73) Assignee: ORTAL—HEATING & AIR CONDITIONING SYSTEMS LTD., Hod Hasharon (IL)

( * ) Notice: Subject to any disclaimer, the term of this patent is extended or adjusted under 35 U.S.C. 154(b) by 155 days.

(21) Appl. No.: 14/830,253

(22) Filed: Aug. 19, 2015

(65) Prior Publication Data

US 2016/0054005 A1 Feb. 25, 2016

Related U.S. Application Data

(60) Provisional application No. 62/040,074, filed on Aug. 21, 2014.

(51) Int. Cl.
*F24B 1/192* (2006.01)

(52) U.S. Cl.
CPC ..... *F24B 1/192* (2013.01)

(58) Field of Classification Search
CPC ..... F24B 1/192
USPC ..... 126/546, 548, 544, 515
See application file for complete search history.

(56) References Cited

U.S. PATENT DOCUMENTS 2,080,708 A * 5/1937 Haines ..... F24B 1/192 126/551
2,958,378 A * 11/1960 Rubens ..... F24B 1/192 126/551
3,018,774 A * 1/1962 Rubens ..... F24B 1/192 126/546
3,378,003 A * 4/1968 Scherer ..... F24B 1/192 126/546
3,605,719 A * 9/1971 Andrews ..... F24B 1/192 126/550
3,901,212 A * 8/1975 Stites ..... F24B 1/1886 126/522

(Continued)

OTHER PUBLICATIONS

Fireplace Screens—WoodlandDirect.com—obtained from http://www.woodlanddirect.com/Fireplace-Accessories/Fireplace-Screens on Oct. 27, 2014.

(Continued)

*Primary Examiner* — Avinash Savani
(74) *Attorney, Agent, or Firm* — Dorsey & Whitney LLP

(57) ABSTRACT

A heating system includes a heating device having an interior and exterior, via which the interior of the heating device can be seen, when the device is installed for its operation, a safety screen configured to prevent access to the exterior of the heating device from a direction opposite to its interior, and a safety screen mounting system. The screen is made of a single sheet of flexible mesh material and is stretchable along its length. The mounting system includes two lateral mounting arrangements configured for fixed attachment of the sheet's side edges to the heating device at locations adjacent the lateral areas of the exterior of the heating device in such a manner that, during the attachment, the sheet is stretched in the direction along its length.

18 Claims, 7 Drawing Sheets

(56) References Cited

U.S. PATENT DOCUMENTS

| | | | | |
|---|---|---|---|---|
| 4,224,922 | A * | 9/1980 | Moncrieff-Yeates | F24B 1/18 126/190 |
| 4,294,224 | A | 10/1981 | Luther, Sr. | |
| 5,188,091 | A | 2/1993 | Gardner | |

OTHER PUBLICATIONS

Fireplace Screens—WoodlandDirect.com—obtained from http://woodlanddirect.com/Fireplace-Accessories/Fireplace-Screens/?state=6 on Oct. 27, 2014.

Fireplace Screens from Napoleaon—obtained from http://www.napoleonfireplaces.com/products/fireplace-screens/ on Oct. 27, 2014.

Lennox Safety Guard: Free Safety Guard Offier for Lennox or Superior Single-Pane, Sealed Glass Front Gas Fireplaces; obtained Nov. 2013.

Woodstove Safety Screen—by Woodfield, obtained Nov. 2013.

Bastrop Petite Convertible Gel Fireplace, Ivory, obtained Nov. 2013.

* cited by examiner

HEATING SYSTEM INCLUDING A SAFETY SCREEN

CROSS-REFERENCE TO RELATED APPLICATIONS

This application claims priority to U.S. Provisional Application No. 62/040,074 filed on 21 Aug. 2014, the disclosure of which is incorporated herein, in its entirety, by this reference.

TECHNOLOGICAL FIELD

The currently disclosed subject matter refers to the field of heating systems, which include a heating device and safety screen for preventing access of the users from the ambient surrounding to the heating device.

BACKGROUND

Heating devices such as stoves, kilns, fireplaces and the like, that provide warmth to the ambient by using gas, electricity, wood burning, etc., most often constitute a part of the interior and thus have an esthetic value. There is a plurality of designs of heating devices in different styles such as modernistic, traditional, minimalistic, etc.

The interior space of the heating devices of the kind referred to above can be directly open to the ambient surrounding such as e.g. in a traditional brick fireplace with metal decorations, or it can be partially or fully separated from the ambient surrounding at one or more sides by one or more transparent walls, to allow the user's viewing of the interior of the heating device, without having an access thereto.

As part of the normal operation of a heating device having at least one transparent wall separating it from the ambient surrounding, such wall can be heated to a rather high temperature, in view of which safety screens are used to prevent direct contact of a user therewith.

Known safety screens can be in the form of free-standing articles that can be placed by the user at any desired distance from the heating device, or they can be assembled with the heating device, and thus form therewith an integral heating system.

Often, safety screens are designed to be transparent to allow the user's viewing of the interior of the heating device, whether directly or via a transparent wall of such device. Some of these transparent safety screens are made using a mesh stretched within a frame, and these include single or multi-panel mesh screens, such as for example those shown in the following links:

http://www.napoleonfireplaces.com/prodducts/fireplace-screens/ http://www.woodlanddirect.com/Fireplace-Accessories/Fireplace-Screens http://www.woodlanddirect.com/Fireplace-Accessories/Fireplace-Screens/?state=6

GENERAL DESCRIPTION

According to one aspect of the presently disclosed, there is provided a heating system comprising a heating device having an interior and exterior, via which the interior of the heating device can be seen, when the heating device is installed for operation, the exterior having two lateral areas, at which it terminates, and at least two adjacent faces that are differently oriented and meet at a merger area;

a safety screen configured to prevent access to the exterior of the heating device from a direction opposite to its interior, the screen comprising a single sheet of flexible mesh material having two opposite side edges and opposite top and bottom edges; and a safety screen mounting system comprising two lateral mounting arrangements configured for fixedly attaching the side edges of said sheet to said heating device at lateral locations adjacent the lateral areas of said exterior, and a safety screen supporting arrangement including a pole configured for being fixedly held in place in vertical orientation in the vicinity of said merger area thereby enabling said sheet, when extending between said lateral locations, to lean upon the pole on its side opposite said interior, so that portions of the sheet disposed on two sides of the pole are provided with orientations corresponding to the orientations of said faces of the exterior of the heating device.

In accordance with another aspect of the presently disclosed subject matter, there is provided a method of providing a heating device with a safety screen, the heating device having an interior and an exterior, via which the interior of the heating device can be seen, when the heating device is installed for its operation, the exterior having two lateral areas, at which it terminates, and at least two adjacent faces that are differently oriented and meet at a merger area, the method comprising:

providing a single sheet of flexible mesh material having two opposite side edges and two opposite top and bottom edges;

providing a pole and mounting it in a vertical orientation in the vicinity of said merger area, on its side opposite said interior;

fixedly attaching the side edges of said sheet to said heating device at lateral locations adjacent the lateral areas of said exterior on the side thereof opposite said interior so that the sheet leans upon the pole, whereby portions of the sheet disposed on two sides of the pole are provided with orientations corresponding to the orientations of said faces of the exterior of the heating device.

In accordance with a further aspect of the presently disclosed subject matter, there is provided a heating system comprising:

an heating device having an interior and exterior, via which the interior of the heating device can be seen, when the device is installed for its operation, the exterior having two lateral areas, at which it terminates, and at least one face, a safety screen configured to prevent access to the exterior of the heating device from a direction opposite to its interior, the screen being made of a single sheet of flexible mesh material and having two opposite side edges defining therebetween the sheet's length and opposite top and bottom edges, the sheet being stretchable along its length;

a safety screen mounting system comprising two lateral mounting arrangements configured for fixed attachment of said side edges to the heating device at locations adjacent the lateral areas of said exterior of the heating device in such a manner that, during said attachment, the sheet is stretched in the direction along its length, the safety screen mounting system being free of any members associated with the top and bottom edges of the sheet, for holding the sheet in such stretched state.

In accordance with a still further aspect of the presently disclosed subject matter, there is provided a method of providing a heating device with a safety screen, the heating device having an interior and an exterior, via which the interior of the heating device can be seen, when the device is installed for its operation, the exterior having two lateral areas, at which it terminates, and at least one face, the method comprising:

providing a single sheet of flexible mesh material having two opposite side edges defining therebetween the sheet's length and opposite top and bottom edges, the sheet being stretchable along its length;

fixedly attaching said side edges to the heating device at locations adjacent the lateral areas of said exterior of the heating device in such a manner that, during said attachment, the sheet is stretched in the direction along its length, and held in such stretched state said locations, being free of any members associated with its top and bottom edges for keeping the sheet in the stretched state.

In the present application and claims, the term 'exterior' with respect to a heating device such as an stove, fireplace or the like, generally means an envelope of a part of the device, which at least virtually separates the interior of the device from the ambient surrounding, allowing the interior to be seen therethrough, when the device is installed for its operation, and which, in the absence of a safety screen, would be directly exposed to the user after the installation of the device. In case the heating device has walls made of transparent material such glass, that separate the interior of the heating device from the ambient surrounding while allowing this interior to be viewed from said surrounding through such walls, the walls constitute faces of the envelope. The term "transparent" refers to a quality of an element, be it a wall of a heating device or a sheet of mesh material, which allows light to pass therethrough so that objects on one side of the element can be distinctly seen from the other side of the element.

In case the heating device has transparent walls, the mesh material used in the safety screen can also be transparent to allow viewing therethrough (and through the transparent walls) the interior of the heating device. In this case, said pole can also be made of a transparent solid material such as glass. The material of the pole can further be colorless so as to make the safety screen supporting arrangement practically invisible to the user. Furthermore, where the interior of the heating device has a specific color, the material of the mesh sheet can be of the same color.

The mesh sheet, when stretched and connected to the heating device, has an operative length, along which it is free of any members required for this connection. With the heating system as described above, such operative length can be not less than that of the total length of said faces of the heating device, thereby not limiting in any way the area thereof, via which the interior of the heating device can be viewed. Moreover, with the safety screen mounting system as described above, the mesh sheet can be stretched along its length and can be held in such stretched state without any frame members at the top and bottom edges of the sheet.

The adjacent faces of the exterior of the heating device can each be planar, i.e. lie in a plane, the two planes defining therebetween a corner constituting said merger area. Alternatively, the faces can be non-planar and constitute differently oriented adjacent portions of a curved exterior of the heating device, the orientation of each such portion being defined by a tangent thereto. In the former case, the number of poles can be equal to the number of corners in the exterior of the heating device, thereby allowing the mesh sheet to take a shape close to that of the exterior of the heating device. In the latter case, the number of poles can depend on the curvature of the exterior of the heating device and the extent, to which the safety screen's curvature is desired conform to the curvature of the exterior of the heating device.

In the present application and claims, the term "mesh" means a net-like structure having open spaces separated by thick partitions, with the diameter of a circle inscribing cross-sectional area of each partition not exceeding the diameter of a circle inscribed in each open space. The mesh can be made of metal, fibers or the like.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
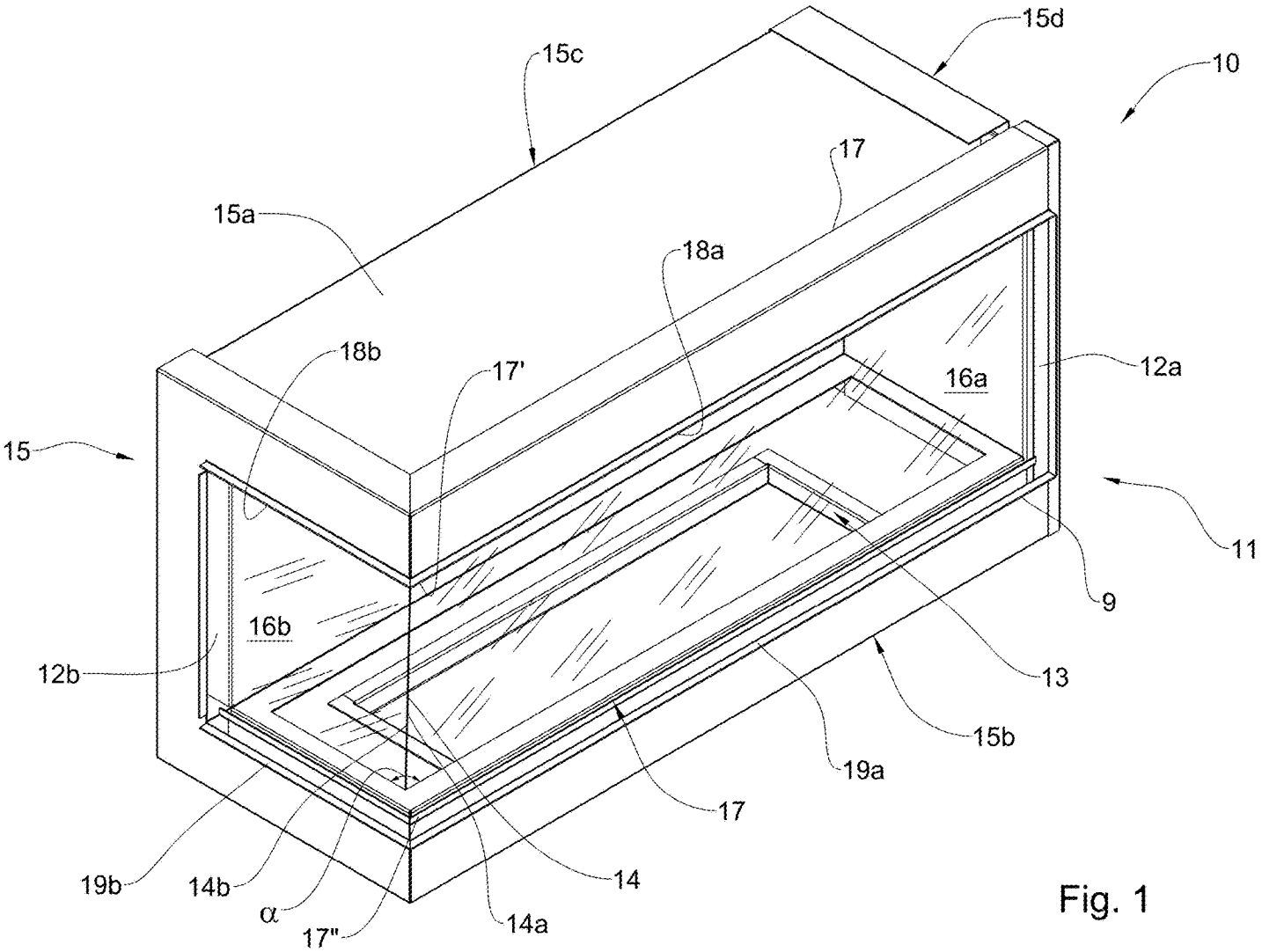
FIG. 1 is a schematic illustration of one example of a heating device (without a safety screen), which can constitute a part of a heating system according to one embodiment of the presently disclosed subject matter.

FIG. 1 schematically illustrate a heating device in the form of a stove 10 having a housing 15, an interior 13 (within the housing) and an exterior 11 with walls in the form of transparent panels 16*a* and 16*b* held by the housing, and a framing 9 connected to the housing and projecting outwardly therefrom. The stove 10 is configured to be installed within a plaster so that its housing 15 and all its functional components (not shown), other than the panels

16*a* and 16*b*, and the interior 13 seen therethrough, are hidden from the viewer's eyes.

Figure 2:
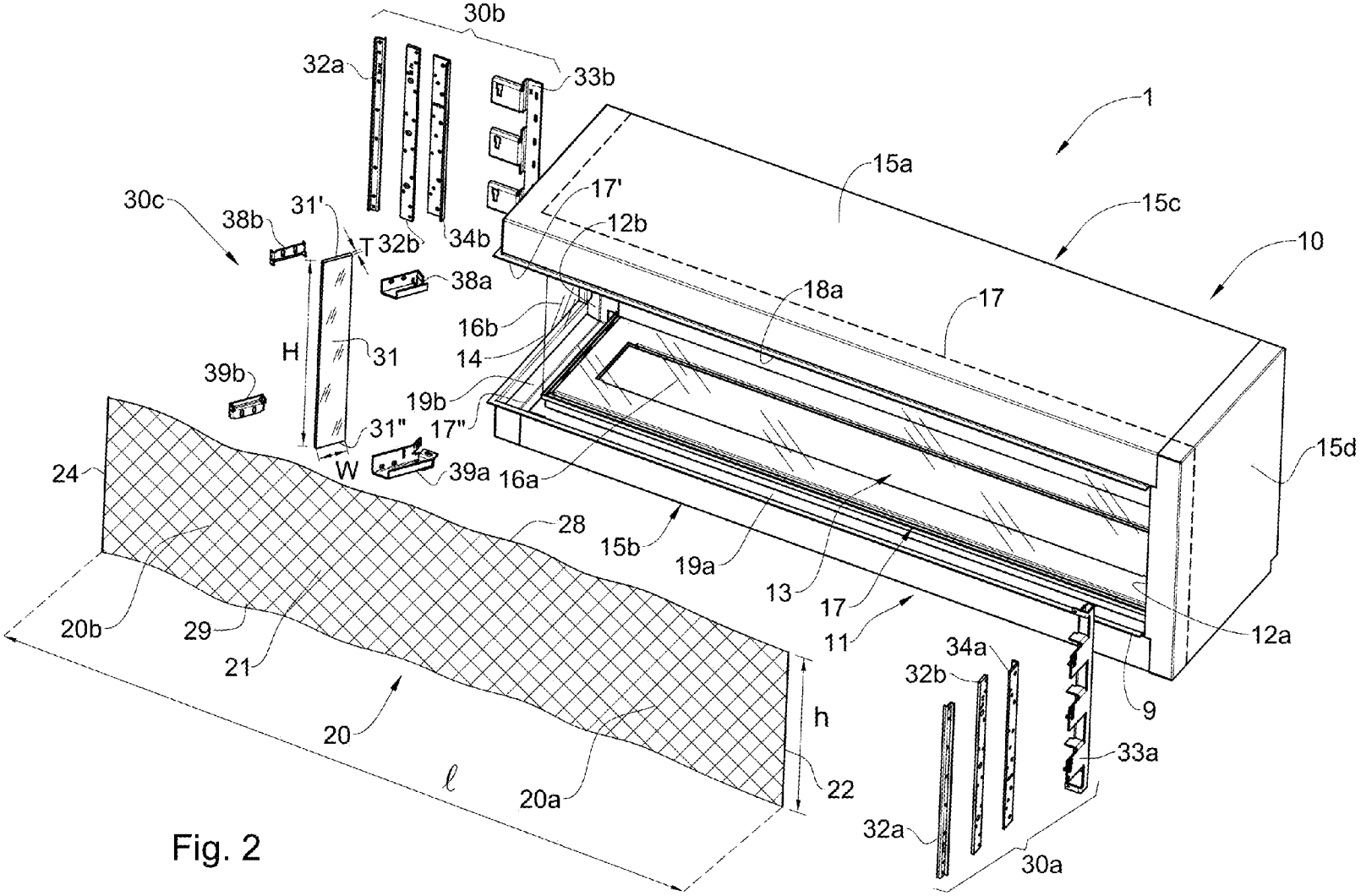
FIG. 2 is a schematic exploded view of a heating system according to one embodiment of the presently disclosed subject matter, which includes a heating device of the kind shown in FIG. 1, and a safety screen according to one embodiment of the presently disclosed subject matter.

As seen in FIG. 1 and also in FIG. 2, the panels 16*a* and 16*b* are oriented transversely with respect to each other and meet to form a corner, whose apex is constituted by a meeting line 14 of adjacent edges 14*a* and 14*b* of the panels. In the described example, the corner is a right corner but this does not need to be the case, and an angle α therebetween can be of any value depending on the design of the stove.

The housing 15 has a body with a top part 15*a*, bottom part 15*b*, back part 15*c*, and side part 15*d*, whose surfaces facing inwardly define the interior 13 of the stove 10.

Portions of the top, bottom and side parts of the body of the housing 15 surrounding the exterior 11 and disposed adjacent thereto at its both sides, constitute an imaginary housing frame 17 (shown by means of dotted lines on the top part 15*a* and side part 15*d* of the housing in FIG. 2), with vertical lateral frame portions 12*a* and 12*b* receiving therein lateral edges of the panels 16*a* and 16*b*, horizontal top frame portions 18*a* and 18*b* receiving therein top edges of the panels 16*a* and 16*b*, and horizontal bottom frame portions 19*a* and 19*b* receiving therein bottom edges of the panels 16*a* and 16*b*. The horizontal top and bottom frame portions meet at respective top and bottom corner frame portions 17' and 17".

The transparent panels 16*a* and 16*b* can be made of glass or transparent thermo-resistant plastic and their adjacent edges 14*a* and 14*b* can be connected to each other by a suitable material such as silicone glue, which can also be transparent. Specifically, these edges can be pressed to each other while having silicone glue along the meeting line 14 therebetween. The silicone glue can also be transparent.

In FIG. 2, the stove 10 is shown as a part of a heating system generally designated at 1, which in addition to the stove 10 comprises a safety screen 20 directed to prevent access of a user to the transparent panels 16*a* and 16*b*.

The safety screen 20 includes a single sheet 21 of a flexible mesh material, which has two opposite side edges 22 and 24 defining therebetween the sheet's length 1, and a top edge 28 and a bottom edge 29 defining therebetween the sheet's height h.

The mesh material can have a color similar or the same to that of the surfaces defining the interior of the stove 13. For example, where at least those surfaces of the interior that are seen to the viewer are black, the mesh material can also be black, thereby preventing the user from distinguishing it over the background of the interior of the stove.

The sheet 21 is mounted to the housing frame 17 by means of a safety screen mounting system, including safety screen lateral mounting arrangements 30*a* and 30*b* and a safety screen supporting arrangement 30*c*.

The safety screen lateral mounting arrangements 30*a* and 30*b* each comprise:

- safety screen holding member 33*a* and 33*b* configured for being mounted to the respective vertical lateral frame portions 12*a* and 12*b*, e.g. by welding or by any suitable mechanical means, such as bolts or screws, at lateral locations disposed on the side of the transparent panels 16*a* and 16*b* opposite the interior of the of the stove;
- safety screen attachment members 32*a* and 32*b* configured for being laterally mounted to the sheet 21 so as to clamp therebetween the side edges 22 and 24 of the sheet; and
- connection members 34*a* and 34*b* configured to connect the safety screen attachment members 32*a* and 32*b* with the side edges of the sheet 21 clamped therebetween, to the respective safety screen holding members 33*a* and 33*b*.

The safety screen supporting arrangement 30*c* comprises an elongated pole 31 having two ends 31' and 31" and configured to be fixedly held in place in a vertical position by pole holding top members 38*a* and 38*b*, and pole holding bottom members 39*a* and 39*b*, configured to be attached to the housing frame 17, e.g. by welding or by mechanical means such as e.g. bolts or screws, in the vicinity of its respective top and bottom corner frame portions 17' and 17".

It should be indicated that, as an alternative to the fixed attachment to the housing frame 17 of the safety screen holding members, 33*a* and 33*b*, and the pole holding members, 38*a* and 39*a*, these members can be formed with the housing frame 17 as a unitary body.

Once the safety screen holding members 33*a* and 33*b* and the pole holding top and bottom members, 38*a* and 39*a*, are all mounted to the housing frame 17 at its corresponding portions, and once the safety screen attachment members 32*a* and 32*b* are mounted to the sheet 21 while clamping its side edges 22 and 24 therebetween, forming thereby safety screen mounting assemblies 23 and 25, the assembly of the safety screen 20 with the stove 10 along its exterior 11 can be performed as follows:

1) Mounting the pole 31 to the stove 10 by the fixation of its ends 31' and 31" between the top and bottom pole holding members, 38*a* and 39*a*, and by embracing these members, 38*b* and 39*b*, around said pole and securing with screws or bolts;
2) Connecting the connection member 34*a* by screws or bolts to the safety screen mounting assembly 23;
3) Connecting the connection member 34*a* by screws or bolts to the respective safety screen holding member 33*a*, thereby fixing in place the edge 22 of the sheet, while leaving free the remainder of the sheet including its safety screen mounting assembly 25;
4) Forcedly pulling the sheet 21 along the panel 16*a* away from the frame lateral portion 12*a*, while stretching it along its length and leaning it upon the pole 31, thereby changing the orientation of the sheet 21 after its contact with the pole to further extend it along the panel 16*b*, while continuing stretching the sheet, until the sheet mounting assembly 25 is brought into proximity of the safety screen holding member 33*b;*
5) Connecting the connection members 34*b* by screws or bolts to the safety screen mounting assembly 25 of the sheet; and
6) Connecting the connection members 34*b* by screws or bolts to the safety screen holding member 33*b*, during which a further stretching force can be applied to the sheet at its edges.

The order of the above operations does not necessarily have to be as presented, and the operations can be performed in different combinations and include different activities as long as the following results are achieved: portions 20*a* and 20*b* of the sheet 21 disposed on two sides of the pole 31 are provided with different orientation corresponding to the different orientation of panels 16*a* and 16*b*, whereby the safety screen 20 is provided with a shape corresponding to that of the exterior 11 of the stove 10, and the sheet 21 is stretched and held in place by its mounting and supporting arrangements. In addition some of the operations can be performed by the manufacturer at his site while the others by the technician at the site of the user, for example one pair of the operations 2-3 or 2-5 or 3-6 or 5-6 can be performed at the manufacturer site.

The material, of which the safety sheet is made, should have such parameters that, when the sheet in its stretched state is held by the above arrangements, it can withstand a concentrated force of at least 50N if applied in the middle of the screen anywhere along its length. One way of verifying this can be by lying the heating system 1 on its back so the longest portion of the safety screen 20*a* takes horizontal orientation and disposing weight of 5 Kg in the middle of the long portion, which is its weak spot, and make sure the weight does not touches the panel 16*a* of the stove, the screen is allowed to be flexed to that extend. These parameters can be wire thickness in the range of 0.1 to 0.5 mm and mesh in the range of 8 to 35 per square inch, in particular a mesh in between 12 and 24 per square inch, also the material should have the ability to be stretched along the length L of the sheet. One example of such mesh material is Blackened stainless steel 12 mesh with a wire thickness of 0.3 mm.

The safety screen 20 can be disassembled from the stove 10 and reassembled back for maintenance, replacing if desired, and the like, without the necessity to disassemble the stove.

It should be indicated that, when the applicant designed the above described safety screen, they desired to minimize the dimension of the pole so as to prevent it from interfering with viewing the interior of the stove 10 through the safety screen 20. On the other hand, as clear from the above description, the pole 31 had to be configured so as to ensure that, when the pole's ends 31' and 31" are tightly held by the top and bottom pole holding members, it can withstand the force, which is applied to it when the sheet 21 is stretched (hereinafter: 'the stretching force'). The applicant thus has surprisingly uncovered that both the above requirements can be met with the pole 31 as shown in FIG. 2, having a planar shape with a height H greater than the height h of the sheet 21, a width W essentially smaller than the height H, and a thickness T essentially smaller than the width W, provided that the pole is made of a sufficiently strong material, such as e.g. tempered glass. One example of such glass proportions of the above parameters can be: W=6÷10 cm and T=5÷8 mm.

Figure 3A:
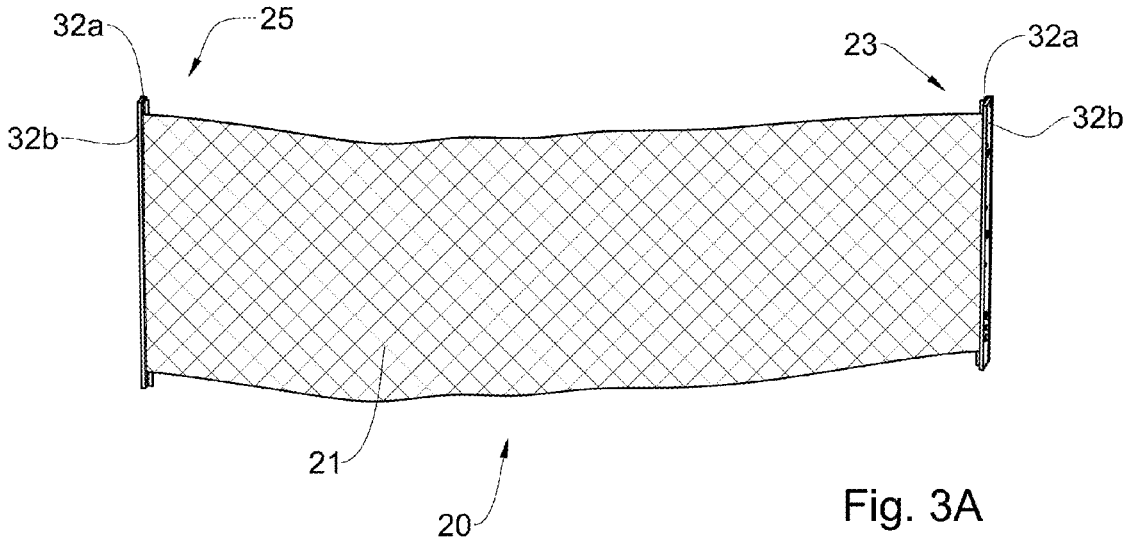
FIG. 3A is schematic illustration of a plan view of safety screen mounting assemblies constituting a part of the heating system shown in FIG. 2.
Figure 3B:
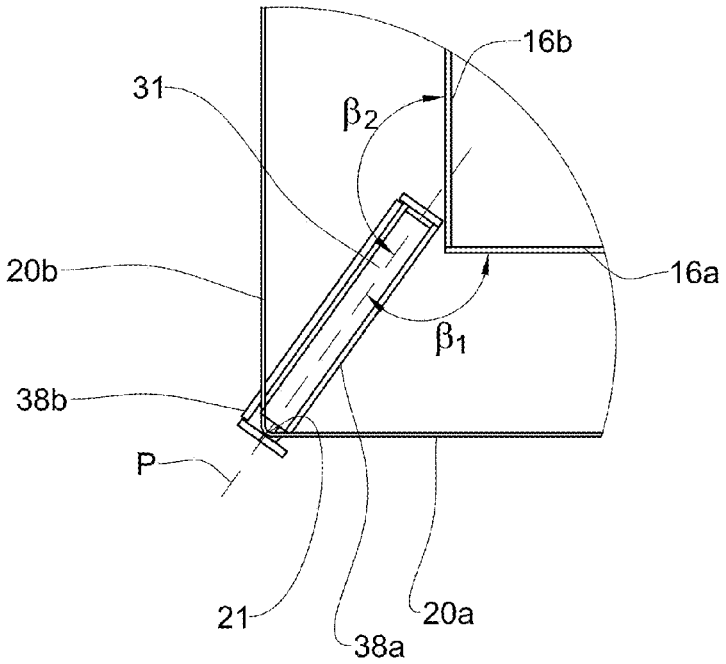
FIG. 3B is schematic illustration of a plan view of safety screen supporting arrangement constituting a part of the heating system shown in FIG. 2.

In addition, the applicant has uncovered that, in view of the different lengths of the panels 16*a* and 16*b*, the withstanding of the stretching force by the pole 31 having the above geometry, can be facilitated by orienting the pole so that it is not disposed symmetrically with respect to the panels. In particular, as shown in FIG. 3B, the pole can be disposed so that, in the plan view of the heating system, elongated plane of symmetry P of the pole crosses only one of the panels (in the present example—the shorter panel 16*b*). In addition or alternatively, angles formed by the pole's elongated plane of symmetry with the panels can be not equal, e.g. angle $\beta_1$ formed with the longer panel 16*a* can be smaller than angle $\beta_2$ formed with the shorter panel 16*b*, i.e. $\beta_1<\beta_2$. The pole 31 is mounted so as to be spaced from the two panels to enable their disassembly for providing access to the interior of the oven for maintenance purposes.

However, in general, it is believed that the pole can be designed to have a geometry and orientation different from those described above as long as it will be configured to withstand the stretching force. For example, it can have an oval, circular or any other appropriate cross-sectional shape, and it can be made of stainless steel or a material different from that specified above.

Figure 4:
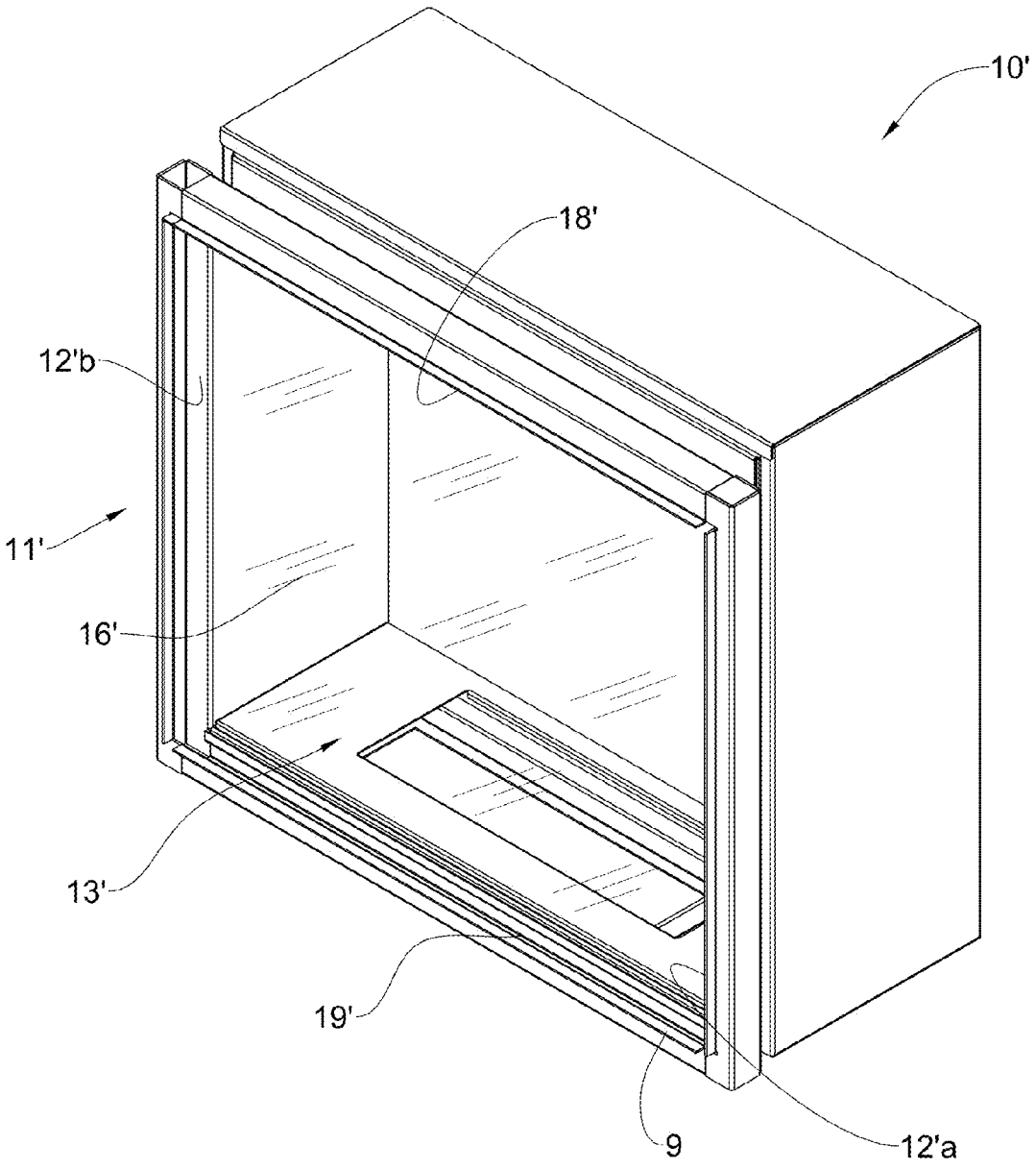
FIG. 4 is a schematic illustration of another example of a heating device (without a safety screen), which can constitute a part of a heating system according to another embodiment of the presently disclosed subject matter.
Figure 5:
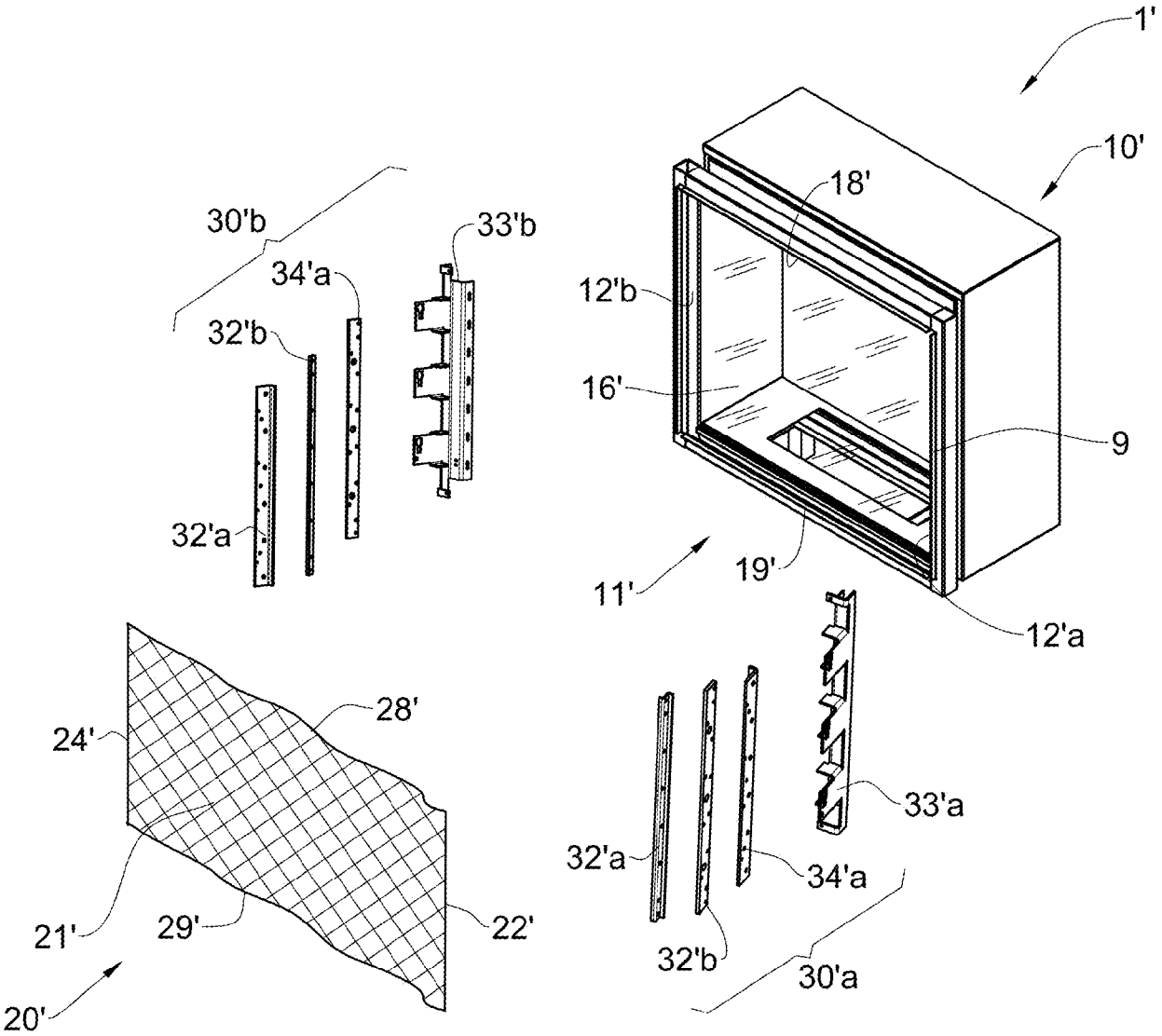
FIG. 5 is a schematic exploded view of a heating system according to another embodiment of the presently disclosed subject matter, which includes a heating device of the kind shown in FIG. 4, and a safety screen according to another embodiment of the presently disclosed subject matter.

FIG. 4 shows another example of an stove 10' with an exterior 11' having two lateral areas 12'*a* and 12'*b* and one transparent wall 16', constituting a part of a heating system 1' shown in FIG. 5, which in addition includes a safety screen 20' comprising a single sheet 21' of the same material as the sheet 21. The sheet 21' is mounted to the stove 10' by means of safety screen mounting arrangements 30'*a* and 30'*b*, in the same manner, in which the sheet 21 is mounted to the stove 10 by the safety screen mounting arrangements 30*a* and 30*b*, with the only difference being in that the heating system 1' does not comprise safety screen supporting arrangement. Such arrangement is not needed in this system because its exterior has only one face.

Figure 6:
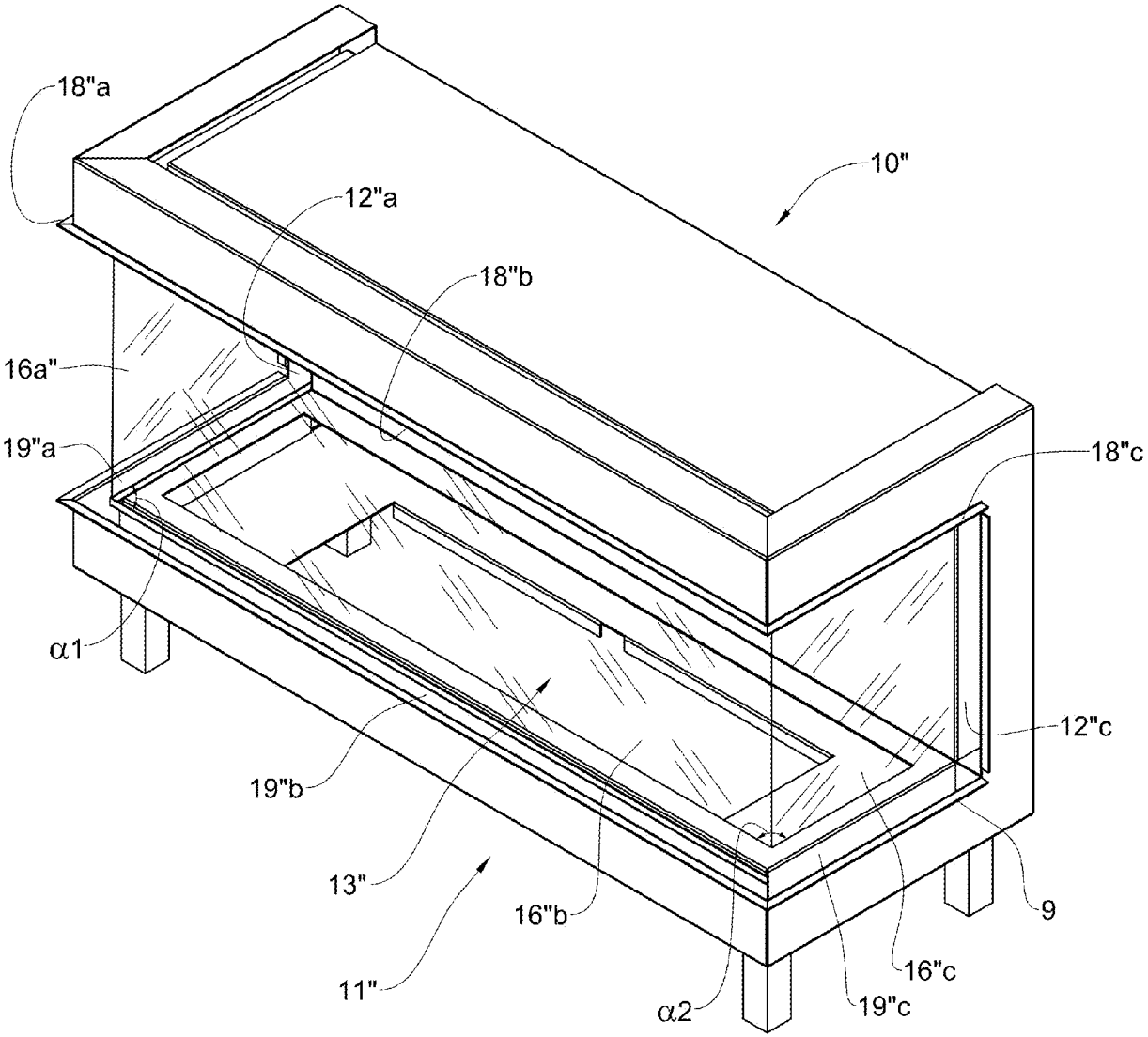
FIG. 6 is a schematic illustration of, yet, another example of a stove (without a safety screen), which can constitute a part of a heating system according to still another embodiment of the presently disclosed subject matter.

FIG. 6 shows another example of an stove 10" with exterior 11" having two lateral areas, 12"*a* and 12"*c*, and three transparent walls 16*a*", 16*b*" and 16*c*" constituting two pairs of adjacent merging faces of the exterior 11" as follows: 16*a*"-16*b*" and 16*b*"-16*c*". This exterior of this stove can be protected by a safety screen in a similar method as that of the stove 10 with the only difference being in the number of poles and corresponding pole holding top and bottom members required for such protection.

In all the above examples, the safety screens are mounted so as to be spaced apart from the exterior of the stoves constituted by their transparent walls to a distance that should normally be not less than 20 mm. This distance depends on the screen parameters such as its length and flexibility, and is obtained by the selection of the width W of the pole 31, its orientation, and the extent to which safety screen holding members are spaced from the edges of the transparent panels in the direction away from the interior of the stoves 10, 10' and 10".

The stoves 10, 10' and 10" are described above without any description of their internal structure and functional units such as gas system, control unit and chimney, which are well known and which have no bearing on the subject matter to which the present application is directed.

Figure 7A:
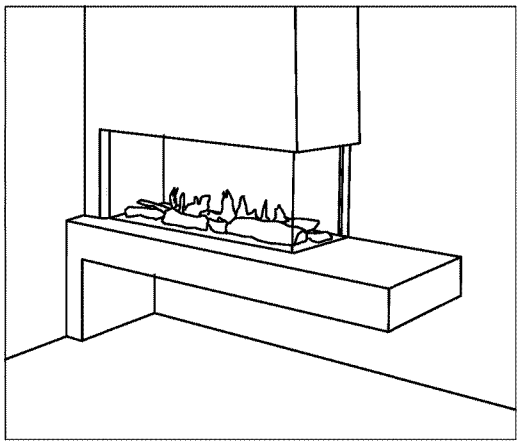
FIGS. 7A to 7D are photographs of existing stoves, which can be modified to include a safety screen according to any aspect of the presently disclosed subject matter.
Figure 7B:
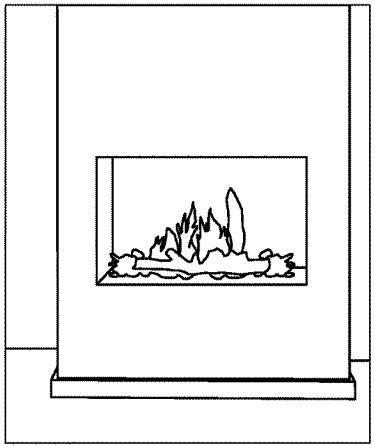
Figure 7C:
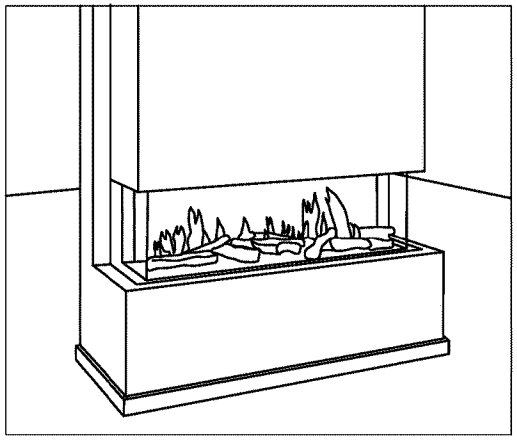
Figure 7D:
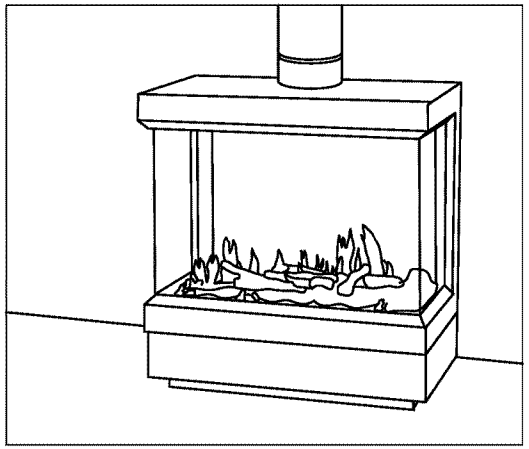

FIGS. 7A to 7D illustrate examples of known stoves with transparent walls, produced by ORTAL Heating & Air Conditioning Systems LTD, Israel, in which safety screens of the kind described above can be used. Such stoves are known in the field as 'frameless' stoves because the transparent walls are not surrounded by a frame visible to the user, like those used in windows. The stoves are shown in FIGS. 7A to 7D as they are installed at a user's site. As seen in FIGS. 7A to 7C, the stoves shown there are installed so that their housing together with their functional units, are all disposed within a plaster structure, whilst the stove of FIG. 7D is of a stand-alone type. There can also exist installation of a combined type (not shown), where a part of the housing is disposed within a plaster structure and the remainder protrudes therefrom. In all these stoves, their exterior, through which the interior of the stoves can be seen, is constituted by their transparent walls. The stoves of FIGS. 7C and 7D have three such walls and two corners at which the walls meet, the stove of FIG. 7A has two such walls and one corner at which the walls meet, and the stove of FIG. 7B has one such wall and no corners at its exterior.

In order to provide these or similar existing stoves with a safety screen as described above, first, the frame of their housing should be modified to allow space for the attachment of safety screen holding members to the lateral portions of the frame and, where there are more than one transparent wall (FIGS. 7A, 7C and 7D), for the attachment of the pole holding members to the corner portion/s of the frame; a sheet of flexible mesh material should be provided, with safety screen attachment members being mounted to the side edges of the mesh sheet; and the pole/s should be provided for its/their installation, normally, at the user's site. The stove can be transported to the user's site with the safety screen been rolled separately or being temporally mounted thereto at the lateral locations by means of the safety screen mounting arrangements, with the mesh sheet being in a loose (non-stretched) state, so as to be stretched during the final assembly of the heating system at the user's site.

The invention claimed is:

1. A heating system, comprising:

a heating device having an interior and an exterior via which the interior of the heating device can be seen when the heating device is installed for operation thereof, the exterior having two lateral areas, at which it terminates, and at least one face, the exterior constituted by at least one wall made of transparent material that separates the interior of the heating device from ambient surrounding while allowing the interior to be viewed from the surrounding through the at least one wall;

a safety screen configured to prevent access to the at least one wall constituting the exterior of the heating device from a direction opposite to the interior thereof, the safety screen being made of a single sheet of flexible mesh material and having two opposite side edges defining therebetween a length of the single sheet of flexible mesh material and opposite top and bottom edges of the single sheet of flexible mesh material, the single sheet of flexible mesh material being stretchable along the length thereof;

a safety screen mounting system including two lateral mounting arrangements configured for fixed attachment of said side top and bottom edges to the heating device at locations adjacent the lateral areas of said exterior of the heating device in such a manner that, during said attachment, the single sheet of flexible mesh material is stretched in the direction along the length thereof, the safety screen mounting system being free of any members associated with the top and bottom edges of the single sheet of flexible mesh material, for holding the single sheet of flexible mesh material in the stretched state.

2. The system according to claim 1, wherein the heating device has at least two adjacent faces that are differently oriented and meet at a merger area; and wherein the safety screen mounting system includes a safety screen supporting arrangement including a pole configured for being fixedly held in place in vertical orientation in the vicinity of said merger area, thereby enabling said single sheet of flexible mesh material, when extending between said lateral locations, to lean upon the pole on the side opposite said interior, so that portions of the single sheet of flexible mesh material disposed on two sides of the pole are provided with orientations corresponding to the orientations of said faces of the exterior of the heating device.

3. The system according to claim 1, wherein the single sheet of flexible mesh material is transparent to allow viewing therethrough the interior of the heating device.

4. The system according to claim 1, wherein said pole is made of a transparent solid material.

5. The system according to claim 1, wherein the single sheet of flexible mesh material, when stretched and connected to the heating device, has an operative length, along which the single sheet of flexible mesh material is free of any members required for this connection.

6. The system according to claim 5, wherein the operative length is not less than that of the total length of said at least one face of the heating device.

7. The system according to claim 1, wherein the single sheet of flexible mesh material is stretched along the length thereof and is held in the stretched state without any frame members at the top and bottom edges of the single sheet of flexible mesh material.

8. The system according to claim 1, wherein the heating device has a housing with a body having portions surrounding the exterior and disposed adjacent thereto at both sides thereof constitute an imaginary housing frame, to which the safety screen is attached at said locations.

9. A heating system, comprising:

a heating device having an interior and exterior via which the interior of the heating device can be seen when the heating device is installed for operation, the exterior having two lateral areas, at which it terminates, and at least two adjacent faces that are differently oriented and meet at a merger area, at least one of the at least two adjacent faces of the heating device constituted by a wall made of transparent material that separates the interior of the heating device from ambient surrounding while allowing the interior to be viewed from the surrounding through the wall;

a safety screen configured to prevent access to the wall of the heating device constituting one of the at least two adjacent faces, from a direction opposite to the interior thereof, the safety screen including a single sheet of flexible mesh material having two opposite side edges and opposite top and bottom edges; and a safety screen mounting system including two lateral mounting arrangements configured for fixedly attaching the side edges of said single sheet of flexible mesh material to said heating device at lateral locations adjacent the lateral areas of said exterior, and a safety screen supporting arrangement including a pole configured for being fixedly held in place in vertical orientation in the vicinity of said merger area thereby enabling said single sheet of flexible mesh material, when extending between said lateral locations, to lean upon the pole on the side thereof opposite said interior, so that portions of the single sheet of flexible mesh material disposed on two sides of the pole are provided with orientations corresponding to the orientations of said faces of the exterior of the heating device.

10. The system according to claim 9, wherein the single sheet of flexible mesh material is stretchable along the length thereof and the two lateral mounting arrangements are configured for fixed attachment of said side edges to the heating device in such a manner that, during said attachment, the single sheet of flexible mesh material is stretched in the direction along the length, the safety screen mounting system being free of any members associated with the top and bottom edges of the single sheet of flexible mesh material, for holding the single sheet of flexible mesh material in the stretched state.

11. The system according to claim 9, wherein the single sheet of flexible mesh material is transparent to allow viewing therethrough the interior of the heating device.

12. The system according to claim 9, wherein the interior of the heating device has a dominant color and a material of the single sheet of flexible mesh material is the same color.

13. The system according to claim 9, wherein the single sheet of flexible mesh material, when stretched and connected to the heating device, has an operative length, along which the single sheet of flexible mesh material is free of any members required for this connection.

14. The system according to claim 13, wherein the operative length is not less than that of the total length of said faces of the heating device.

15. The system according to claim 9, wherein the single sheet of flexible mesh material is stretched along the length thereof and is held in the stretched state without any frame members at the top and bottom edges of the sheet.

16. The system according to claim 9, wherein the adjacent faces of the exterior of the heating device each lie in a plane, the two planes defining therebetween a corner constituting said merger area.

17. The system according to claim 16, wherein the number of poles is equal to the number of corners in the exterior of the heating device, thereby allowing the single sheet of flexible mesh material to take a shape close to that of the exterior of the heating device.

18. The system according to claim 9, wherein the heating device has a housing with a body having portions surrounding the exterior and disposed adjacent thereto at both sides thereof constitute an imaginary housing frame, to which the safety screen is attached at said locations.

* * * * *